United States Patent [19]

Verdier et al.

[11] Patent Number: 4,617,098

[45] Date of Patent: Oct. 14, 1986

[54] CONTINUOUS ELECTROLYSIS OF LITHIUM CHLORIDE INTO LITHIUM METAL

[75] Inventors: Jean-Michel Verdier, Paris; Serge Jacubert, Viroflay; Jean Grosbois, L'Isle; Jean-Yves Dumousseau, Paris, all of France

[73] Assignee: Rhone-Poulenc Specialites Chimiques, Courbevoie, France

[21] Appl. No.: 788,170

[22] Filed: Oct. 16, 1985

Related U.S. Application Data

[63] Continuation-in-part of Ser. No. 749,113, Jun. 26, 1985, abandoned, which is a continuation of Ser. No. 527,849, Aug. 30, 1983, abandoned, and a continuation-in-part of Ser. No. 705,016, Feb. 25, 1985, abandoned.

[30] Foreign Application Priority Data

Aug. 31, 1982 [FR] France ..... 82 14865
Feb. 24, 1984 [FR] France ..... 84 02840

[51] Int. Cl.[4] ..... C25C 3/02; C25C 7/08

[52] U.S. Cl. ..... 204/68; 204/245; 204/247

[58] Field of Search ..... 204/68, 245, 247

[56] References Cited

U.S. PATENT DOCUMENTS

| | | | |
|---|---|---|---|
| 1,921,377 | 8/1933 | Ward | 204/247 |
| 3,962,064 | 6/1976 | Brut | 204/68 |
| 4,073,703 | 2/1978 | Kinosz et al. | 204/247 |

*Primary Examiner*—Howard S. Williams
*Attorney, Agent, or Firm*—Burns, Doane, Swecker & Mathis

[57] ABSTRACT

Lithium metal is continuously prepared by, in a specially adapted electrolytic cell, (i) continuously electrolyzing the lithium chloride which comprises a mixture of molten salts, which mixture comprises the medium of electrolysis and such medium of electrolysis naturally circulating within an interspace defined between the electrodes of the cell, said interspace being devoid of physical barrier between said electrodes, (ii) continuously withdrawing therefrom product lithium metal in admixture with the mixture of molten salts, and (iii) continuously discharging undiluted chlorine gas therefrom.

41 Claims, 4 Drawing Figures

CONTINUOUS ELECTROLYSIS OF LITHIUM CHLORIDE INTO LITHIUM METAL

CROSS-REFERENCE TO RELATED APPLICATION

This application is a continuation-in-part of application Ser. No. 749,113, filed June 26, 1985, which is a continuation of application Ser. No. 527,849, filed Aug. 30, 1983, and a continuation-in-part of application Ser. No. 705,016, filed Feb. 25, 1985, all of which prior applications are now abandoned.

BACKGROUND OF THE INVENTION

1. Field of the Invention

The present invention relates to apparatus and process for the continuous preparation and separation of lithium by the electrolysis of lithium chloride contained in a mixture of molten salts.

2. Description of the Prior Art

The preparation of lithium by the electrolysis of lithium chloride contained in a mixture of molten salts based upon lithium chloride and at least one alkali and/or alkaline earth metal chloride, is known to this art and has been described, for example, in connection with processes for the preparation of silane, in U.S. Pat. Nos. 3,078,218 and 3,163,590. These particular patented processes are characterized by at least one of the following attributes:

(1) The process is carried out semi-continuously, i.e., the electrolytic cell is charged with an electrolyzable mixture and the electrolysis of the desired amount of lithium chloride is conducted in such mixture, after which a fresh charge of lithium chloride is added to the remaining mixture; and (2) Complex and delicate apparatus is required, on the one hand to separate, in the electrolyzer itself, the lithium obtained from the mixture of molten salts, and, on the other hand, to prevent the recombination of the gaseous chlorine produced with the lithium; thus, for example, the atmosphere in the cell above the layer of lithium is very carefully controlled and a diaphragm is placed in the bath between the anode and the cathode.

SUMMARY OF THE INVENTION

Accordingly, a major object of the present invention is the provision of an improved, simplified such process for the continuous electrolysis of lithium chloride to lithium metal, said improved process being characterized in that:

(a) It is carried out continuously;

(b) The product metallic lithium is not separated from the mixture of molten salts in the electrolyzer itself, such that a mixture consisting of metallic lithium and the mixture of molten salts is withdrawn from the electrolyzer, whereby the conduct of the electrolysis reaction is considerably simplified;

(c) The electrolysis is carried out without the need for a diaphragm between the anode and the cathode, but rather by establishing in the interspace between the anode and the cathode a rapid natural circulation of the medium of electrolysis;

(d) The anode is protected against possible attack by the lithium floating on the surface of the electrolytic medium and against a possible direct reoxidation of lithium on the anode by encasing said anode, to a point below the surface of said medium, within an insulating refractory material; and (e) The chlorine produced by means of the electrolysis is continuously withdrawn in the absence of dilution with an inert gas, which permits its immediate industrial utilization.

In a preferred embodiment, the downstream separation of lithium metal is accomplished by continuously transferring the withdrawn admixture of the lithium metal and the molten salts into a zone of separation advantageously comprising a separator and there, continuously separating lithium metal from the molten salts, said molten salts then being recycled back into the electrolyzer, if desired, optionally after the filtration thereof.

In another preferred embodiment, the separator, into which the withdrawn lithium metal/molten salts admixture is transferred comprises both a decantation compartment and a discharge well, whereby the metallic lithium is decanted in said decantation compartment, from which it itself is withdrawn, and the molten salts are separated in the discharge well, from which they are in turn discharged, but most preferably recycled, after optional filtration/purification, back into the electrolyzer feed.

DETAILED DESCRIPTION OF THE INVENTION

Figure 1:
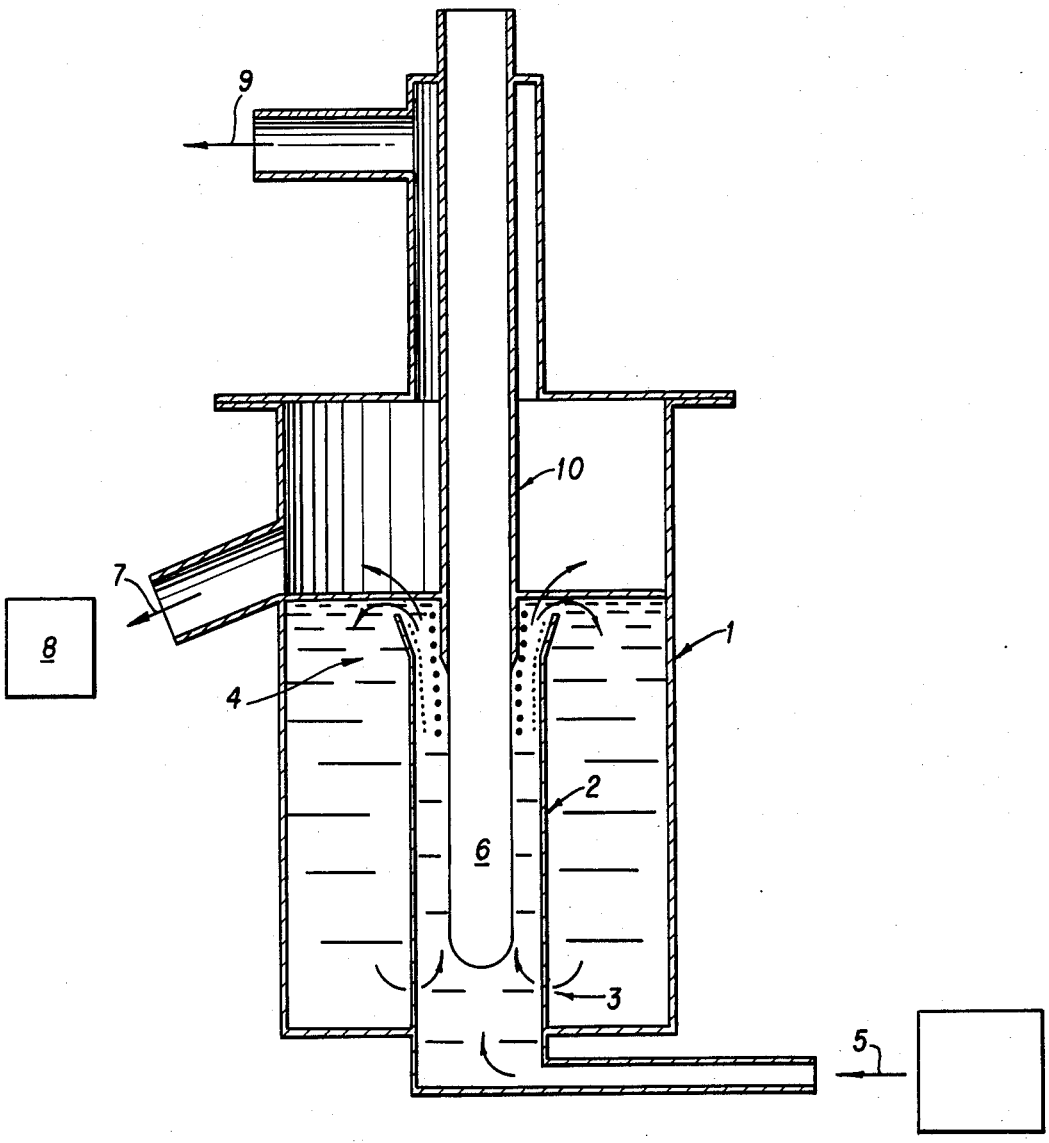
FIG. 1 is a diagrammatic cross-sectional view of one suitable electrolytic cell according to the invention.

More particularly according to this invention, it will be appreciated that if it is desired to separate pure lithium metal from the admixture withdrawn from the electrolyzer, any of the known methods for separation of the metal from the mixture of molten salts may be used.

The electrolytic medium advantageously comprises a mixture of molten salts based upon lithium chloride and at least one other alkali and/or alkaline earth metal chloride, which, with the lithium chloride, forms a eutectic mixture melting at a temperature ranging from about 320° to 360° C. As an exemplary such binary mixture, lithium chloride and potassium chloride are representative; an exemplary such ternary mixture, mixtures containing, in addition to lithium chloride and potassium chloride, a chloride selected from among the chlorides of sodium, rubidium, strontium, magnesium, calcium and barium, are representative.

In all cases, the operation is carried out in a liquid medium, with the electrolysis taking place at a temperature ranging from about 400° to 500° C., and preferably at about 450° C.; it is therefore appropriate that the mixture of molten salts introduced into the electrolysis zone have a composition rather close to the eutectic composition of the mixture used, with an excess of the lithium chloride to be subjected to electrolysis. Thus, for example, if the electrolytic medium comprises a mixture of lithium chloride and potassium chloride, it is considered that at approximately 450° C. the amount of lithium chloride in said mixture could vary from about 69 mole % in the mixture of molten salts introduced as feed to the electrolyzer to about 56 mole % in the mixture withdrawn from the electrolyzer. In this case, lithium chloride may be present in an excess of up to 10 mole % with respect to the eutectic composition of the mixture of molten salts comprising the lithium chloride and potassium chloride.

The first distinguishing characteristic of the process according to the invention is that it is carried out in continuous fashion, i.e., the electrolytic cell is continuously supplied with a fluid consisting of the mixture of molten salts containing, as the electrolyzable material, lithium chloride, and the products of electrolysis are continuously removed from the electrolyzer, i.e., chlorine, on the one hand, and the mixture of metallic lithium and molten salts, on the other.

As another distinguishing characteristic, it has already been mentioned that the lithium is not separated from the mixture of molten salts. This characteristic, combined with the natural circulation of the medium of electrolysis, more fully discussed hereinbelow, has the consequent, as a result thereof, that the molten salts play a protective role in view of the possible recombination of the lithium floating on the surface of the mixture of molten salts with the chlorine that forms the atmosphere above the electrolytic medium. It is, therefore, unnecessary to take any particular precautions to isolate the electrolytic medium from said chlorine atmosphere.

Furthermore, the electrolysis is carried out without the use of a diaphragm by virtue of the establishment of a rapid natural circulation of the electrolytic medium. This circulation is designated natural because it is obtained simply by the effect of the entrainment within the electrolytic medium of chlorine bubbles, which are released at the anode; it is therefore unnecessary, but not prohibited consistent herewith, to use means of circulation independent of these natural means. Also, as the electrolytic medium is vertically entrained by the ascending movement of the chlorine bubbles in the interspace located between the anode and the cathode, it is appropriate to effect recirculation of said medium in the cell by causing the said medium to redescend in the space located beyond the cathode, to repenetrate, through conveniently arranged orifices, the interspace located between the anode and the cathode. The speed of circulation of said medium is high, because if Vo is the velocity of movement of the electrolytic medium in the interspace between the anode and the cathode in the absence of natural recirculation, the velocity V actually obtained by virtue of said recirculation is approximately 100 times Vo (in the various experiments carried out, it varied on the average between 0.5 to 5 cm/sec).

To make possible this natural circulation of the electrolytic medium, the upper portion of the cathode is immersed and preferably has an upwardly flared configuration.

The ascending movement of the electrolytic medium, combined with the preferred upwardly flared configuration of the cathode, tends to bias the lithium against the sidewalls of the electrolytic cell and thus to facilitate its natural elimination by partial reduction of the content thereof, while minimizing recombination with chlorine.

Finally, the anode must be protected against possible attack by floating or supernatant lithium by means of an isolating sheath of a refractory material submerging into the electrolytic bath. Refractory material is defined as any material that remains inert at the temperature of electrolysis with respect to the materials with which said refractory material is in contact, i.e., essentially the mixture of molten salts, chlorine and lithium. The material must be electrically insulating. For the sheathing of the anode, therefore, a material such as alumina, quartz, silica, thoria, zirconia or beryllium oxide, is used.

In another embodiment of the process of the invention, it is possible to prepare by said process and in a similar manner lithium/calcium alloys containing at least mole % of lithium; in this case, the electrolysis of a mixture of lithium chloride and calcium chloride is effected in a mixture of molten salts and under conditions similar to those described hereinabove.

Another feature of the invention lies in alternative step (ii) whereby the lithium metal produced and the mixture of the molten salts withdrawn from the electrolyzer are separated in the separator. The separator is charged with the lithium/molten salts admixture withdrawn from the electrolyzer and includes a decantation compartment as well as a discharge well, said decantation compartment preferably having a surface area S such that $0.1<S/Q<0.3$, wherein Q is the rate of feed into said separator in $m^3/h$ and S the surface area in $m^2$ of said decantation compartment; the supernatant or floating light phase is the lithium metal, which is withdrawn from the separator, and the remaining dense phase consisting of the molten salts is, preferably, recycled after optional filtration back into the electrolyzer feed. When such recycling is indeed carried out, lithium chloride should advantageously also be added to the electrolyzer feed such that the concentration thereof remains within those limits noted hereinbefore; the amount of added lithium chloride preferably corresponds to that which has been consumed as a result of the electrolysis.

Optional filtration of the mixture of molten salts is preferably carried out through a porous metal material such as, for example, sintered stainless steel.

The temperature in the separator is preferably close, if not identical, to that in the electrolyzer.

The process according to the invention thus features an electrolytic cell and an electrolytic cell/separator combination having the technical characteristics described hereinbelow:

(a) The cell comprises a sheathed anode surrounded by a cathode; the upper end portion of the cathode immersed in the electrolytic bath preferably is upwardly and outwardly flared in configuration and orifices are provided in the lower end or base portion of said cathode;

(b) The feed to the cell is preferably carried out via an inlet for the mixture of molten salts located at the base of the cell;

(c) The cell is also provided with various outlet means, for withdrawing, on the one hand, the mixture of molten salts and the metallic lithium and, on the other hand, the gaseous chlorine. These means comprise an overflow tube and an exhaust for the gaseous phase present above the electrolytic medium.

Preferably, the cell is provided with various outlet means, for transferring, on the one hand, the mixture of molten salts and the metallic lithium into the separator and, on the other hand, for discharging the gaseous chlorine. These various outlet means include an overflow tube or conduit spilling into the separator and an exhaust port, surmounting the medium of electrolysis, for the gaseous phase thereabove; and, (d) The separation of the preferred embodiment, which is charged with the lithium/molten salts admixture exiting the electrolyzer comprises:

(i) a decantation or phase separation compartment of surface area S;

(ii) means for discharging or recovering the upper light phase (the lithium metal) by overflow; and (iii) means for discharging the dense bottom phase, i.e., the mixture of molten salts, advantageously to recycle and comprising a well and an overflow therefor.

In one embodiment of the invention, as shown in FIG. 1 of the drawings, the electrolytic cell is comprised of a single anode/cathode pair. Such electrolytic cell further comprises a stainless steel housing 1, and the cathode 2, also fabricated from stainless steel, is cylindrical in configuration. The cathode 2 is welded to the bottom of the cell and, at the lower extremity thereof, is provided with a plurality of orifices 3, which permit the circulation of the electrolytic medium within the electrolyzer. The upper end portion 4 of the cathode 2 is placed such that it will continuously remain under the surface of the medium of the electrolysis (when the cell is in operation) and is outwardly flared in configuration. The anode 6 is made of graphite, is cylindrical in shape and is situated within the cathode 2. Anode 6 is sheathed over the surface area thereof extending above the electrolytic medium and to a certain extent below the surface of said medium (when the cell is in operation), by alumina sheathing 10.

The introduction of the mixture of molten salts is accomplished by means of an inlet conduit 5 which is in open communicating relationship with the base of the cell, directly under the interspace located between the anode and the cathode. The venting or exhaust of the gases (chlorine) is provided for at the upper extremity of the cell, via outlet conduit 9. Withdrawal of the mixture resulting from the electrolysis operation is provided by the outlet conduit 7, which determines the level of the electrolytic medium in the cell. Dimensionally, the distance between the anode and the cathode is on the order of about 1 to 5 cm and the height of the medium of electrolysis (essentially, the immersed height of the anode) is on the order of 2 to 10 cm.

Thus, it will immediately be appreciated that the chlorine evolved or released over the course of the electrolysis is extracted or discharged from the electrolyzer without being diluted with, for example, an inert gas. This characteristic is important to the extent that the chlorine may be utilized industrially.

The aforedescribed cell may be used to carry out the electrolysis of lithium chloride in a medium of molten salts, or, according to another embodiment of the invention, to simultaneously effect the electrolysis of lithium chloride and calcium chloride (providing Li/Ca alloys), if the latter material is present in the mixture.

According to the invention, the electrolysis of lithium chloride is carried out in a mixture based upon lithium chloride and potassium chloride, the composition of which being approximately eutectic. For an intensity of 45 A with an active cathodic surface area of 80 $cm^2$ and an anodic surface area of 40 $cm^2$, the interpolar distance being 1.6 cm, faradic yields of 85 to 90% are obtained using a voltage of 6.0 volts.

It will thus be seen that this apparatus, which is relatively simple, makes it possible to obtain lithium at highly satisfactory energy costs (27 kW/kg lithium).

In the Li/Ca alloy embodiment of the invention, the electrolysis of a mixture based on lithium chloride-potassium chloride and calcium chloride is carried out, such mixture having a composition of approximately eutectic. For an intensity of 40 A, with an active cathodic surface area of 1.5 $dm^2$ and an anodic surface area of 0.47 $dm^2$ (the distance between the electrodes being 2 cm), the faradic yield is higher than 85%, the voltage at the terminals of the cell is 6.6 V and the Li/Ca alloy obtained contains 76 mole % of Li and 24 mole % of Ca.

Figure 2:
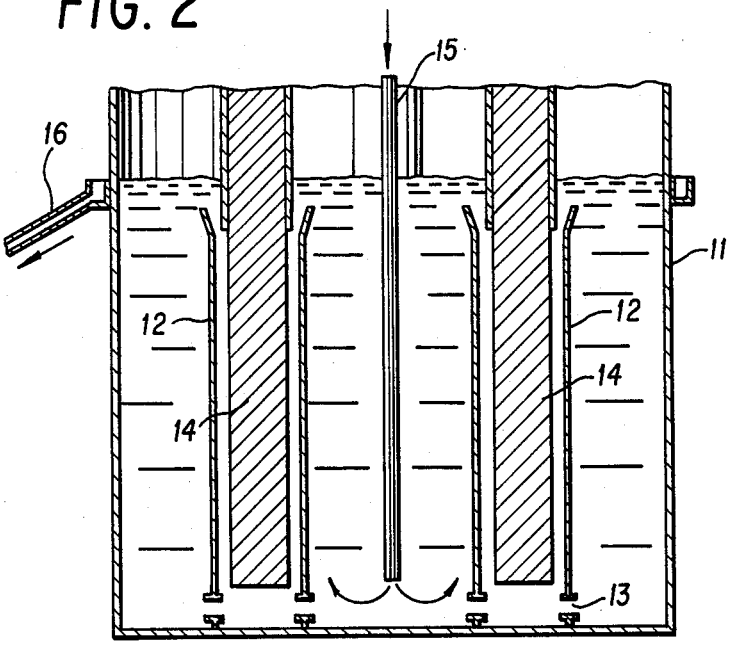
FIG. 2 is a diagrammatic cross-sectional view of another suitable electrolytic cell according to the invention.
Figure 2A:
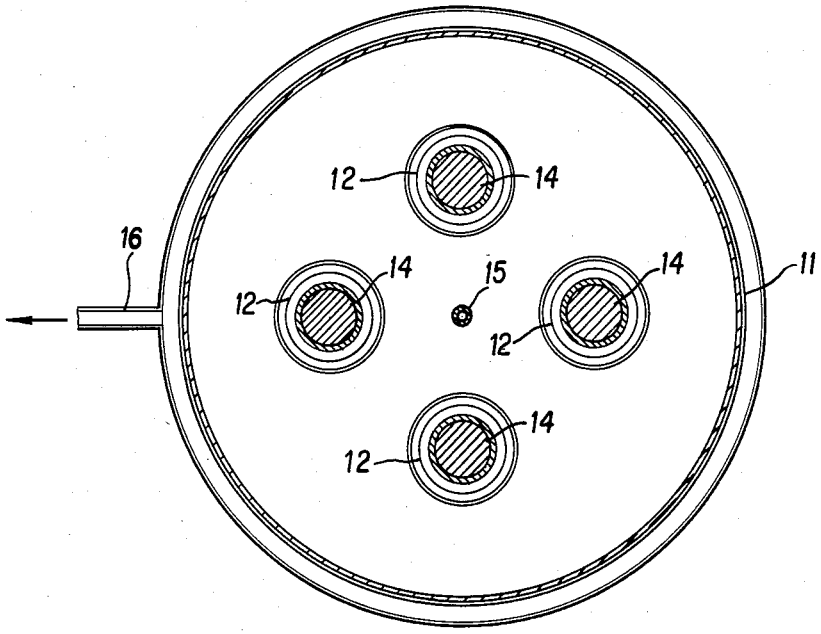
FIG. 2*a* is a top view of the electrolytic cell shown in FIG. 2.

The scale-up of the electrolytic apparatus described hereinabove to an industrial scale may be effected, for example, as shown in FIGS. 2 and 2*a* by using more than one anode/cathode pairs.

In FIGS. 2 and 2*a*, the sidewall of the electrolyzer is shown at 11. Cathodes 12 are situated within the electrolyzer; the cathodes 12 are perforated at 13, at the respective lower end portions thereof. The anodes 14 are appropriately sheathed with alumina, as shown and as hereinbefore described. Inlet conduit 15 provides for the feed of the mixture of molten salts into the electrolyzer. Withdrawal of the mixture of electrolysis is provided for via outlet conduit 16.

The immediately aforedescribed electrolytic cell has a total diameter of approximately 120 cm, the graphite anodes 14 have a diameter on the order of 14 cm, the cathodes surrounding the anodes have an internal diameter of approximately 20 cm and are made of steel. The upper end portion of each anode is sheathed with alumina, as above described.

The cell is supplied with a mixture of molten lithium chloride-potassium chloride, containing an excess of lithium chloride of approximately 10 mole % (with respect to eutectic). The temperature of the electrolysis is 450° C., and the operation is carried out at 12 kA ($4\times3$ kA) (density of the anodic current is 85.2 $A/dm^2$ and that of the cathodic current is 58.7 $A/dm^2$) and under 7 V. With suitable feedstream, a production of 2.8 kg/hour of lithium dispersed in the mixture of molten salts is obtained, corresponding to a faradic yield of 90%.

Figure 3:
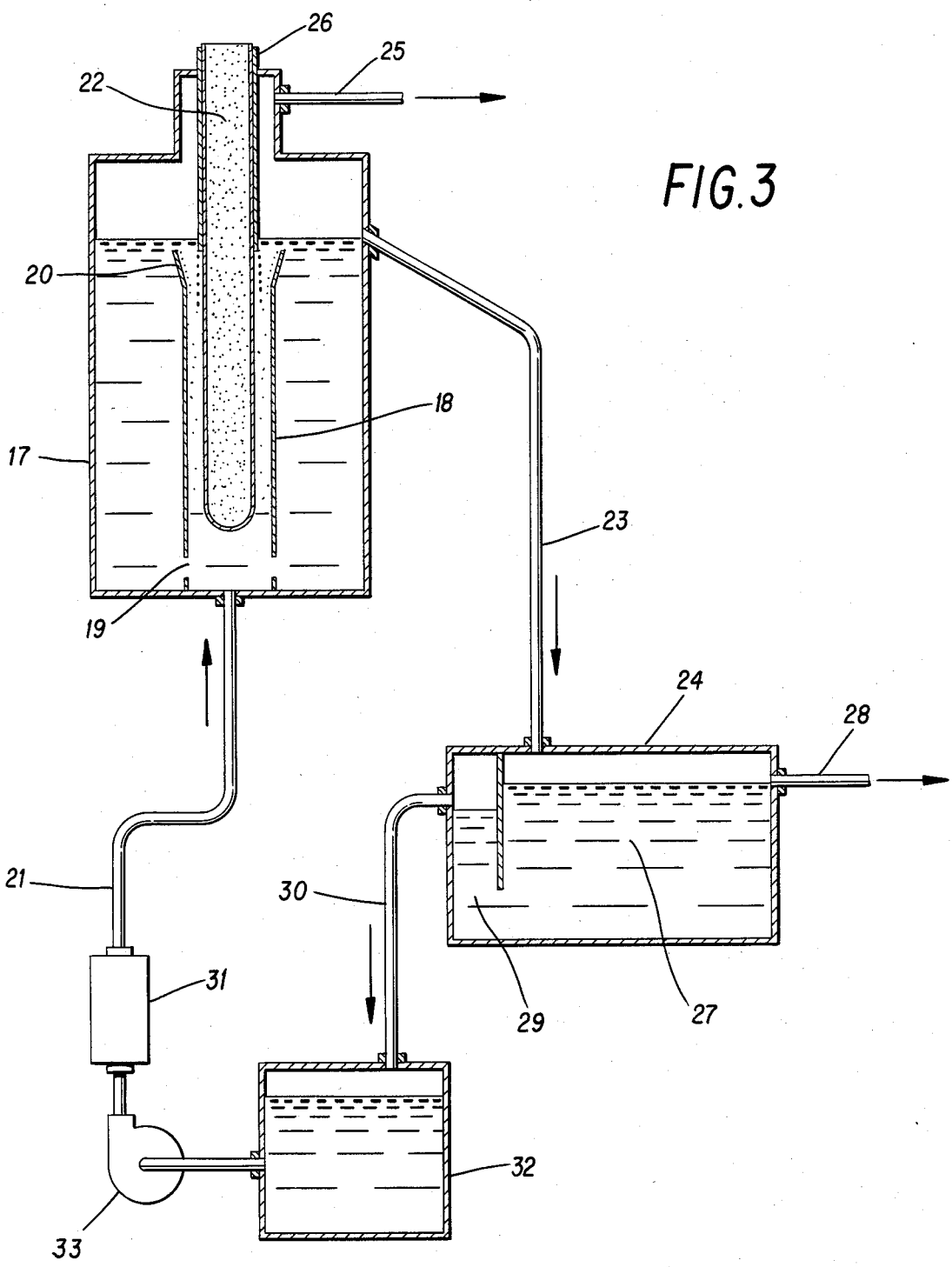
FIG. 3 is a diagrammatic/schematic cross-sectional view of suitable apparatus/process according to the invention.

In one preferred embodiment of the invention, as shown in FIG. 3, the electrolytic cell is comprised of an anode/cathode pair. Such electrolytic cell further comprises a stainless steel housing 17, and the cathode 18, also fabricated from stainless steel, is cylindrical in configuration. The cathode 18 is welded to the bottom of the cell and, at the lower extremity thereof, is provided with a plurality of orifices 19, which permit the circulation of the electrolytic medium within the electrolyzer. The upper end portion 20 of the cathode 18 is placed such that it will continuously remain under the surface of the medium of the electrolysis (when the cell is in operation) and is upwardly and outwardly flared in configuration. The anode 22 is made of graphite, is cylindrical in shape and is situated within the cathode 18. Anode 22 is sheathed over the surface area thereof extending above the electrolytic medium and to a certain extent below the surface of said medium (when the cell is in operation), by alumina sheathing 26.

The introduction of the mixture of molten salts is accomplished by means of an inlet conduit 21 which is in open communicating relationship with the base of the cell, directly under the interspace located between the anode and the cathode. The venting or exhaust of the gases (chlorine) is provided for at the upper extremity of the cell, via outlet conduit 25. Withdrawal of the mixture resulting from the electrolysis operation is provided by the outlet conduit 23, the level thereof determining the level of the electrolytic medium in the cell.

Thus, it will immediately be appreciated that the chlorine evolved or released over the course of the electrolysis is extracted or discharged from the electrolyzer without being diluted with, for example, an inert gas. This characteristic is important to the extent that the chlorine may be utilized industrially.

The separator 24 is charged, via inlet line 23, at a flow rate Q with the mixture emanating from the electrolysis cell, said separator comprising:

(i) a decantation compartment 27 having surface area S;

(ii) means 28 for discharge of the light phase (lithium metal) by overflow;

(iii) means for discharge of the dense lower phase, including a well 29, an overflow 30 and, advantageously, a buffer vessel 32.

The dense phase which essentially consists of the mixture of molten salts is recycled via line 21 into the cell 17 after filtration in the filter 31.

The amount of lithium chloride in the electrolysis medium is adjusted to replace that consumed as a result of the electrolysis by addition thereof, advantageously, to the buffer vessel 32. Furthermore, circulation of the molten medium is effected by pump 33 which may, for example, be located downstream of the vessel 32.

In order to further illustrate the present invention and the advantages thereof, the following specific example is given, again referring to the accompanying FIG. 3, it being understood that same is intended only as illustrative and is nowise limitative.

EXAMPLE

The electrolytic cell 17 had a diameter of 0.7 m and a height of one meter, with the cathode 18 having an inner diameter of 0.34 m and the graphite anode a diameter of 0.3 m (the upper end portion of the anode was sheathed in an alumina tube 26).

The separator 24 was cylindrical in shape, 0.5 m in diameter, corresponding to a height of 0.5 m, and had a surface area of 0.2 $m^2$; the rate of feed thereto was 1 $m^3$/hour.

Downstream of the buffer tank 33 was a pump enabling filtration of the salts under pressure in a filter 31 made of sintered stainless steel.

The trial flow rate (feedstream 5) was 1 $m^3$/hour and the current of electrolysis was 5,000 A. The following balance was determined:

(1) at the inlet of the electrolyzer (feedstream via line 5):

(i) KCl flow rate=11,111 moles/h;

(ii) LiCl flow rate=18,518 moles/h (62.5 moles per 100 in the molten salt);

(2) at the liquid outlet of the electrolyzer (stream 7):

(i) KCl flow rate=11,111 moles/h;

(ii) LiCl flow rate=18,351 moles/h (62.3 moles per 100 in the molten salt);

(iii) Li flow rate=167 moles/h; and (3) at the gas outlet of the electrolyzer (stream 9):

(i) $Cl_2$ flow rate=83.5 moles/h.

The stream in the line 23 was divided into two fractions in the separator 24, a first stream in the line 30 from the well consisting of a homogeneous dense phase of the molten salts LiCl and KCl, and a second stream in the line 28 consisting of a light lithium phase corresponding to the output of the electrolysis.

The recovered salts in vessel 16 were continuously pumped to be recycled to the electrolyzer after filtration through the metal sinter in the filter 31.

In this Example, the balance of 167 moles/h of LiCl was maintained by additions to the buffer tank 32.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. A process for the continuous preparation of predetermined amount of lithium metal, comprising (i) in an electrolytic cell, continuously electrolyzing a mixture of molten salts which comprises lithium chloride, which mixture comprises the medium of electrolysis, such medium of electrolysis being in natural circulation within an interspace defined between the electrodes of the cell, said interspace being devoid of physical barrier between said electrodes, and said natural circulation maintaining product lithium metal so formed in admixture with the mixture of molten salts (ii) continuously withdrawing from said cell an admixture of product lithium metal with the mixture of molten salts, and (iii) continuously discharging undiluted chlorine gas therefrom.

2. The process as defined by claim 1, further comprising the step of (iv) separating the admixture of product lithium metal with the mixture of molten salts as withdrawn from the electrolyte cell in step (ii) into product lithium metal and mixture of molten salts.

3. The process as defined by claim 1, said mixture of molten salts comprising lithium chloride and at least one other alkali or alkaline earth metal chloride.

4. The process as defined by claim 3, said mixture of molten salts being essentially eutectic in composition.

5. The process as defined by claim 4, said mixture of molten salts comprising lithium chloride and potassium chloride.

6. The process as defined by claim 5, said lithium chloride being present in an excess of up to 10 mole % with respect to the eutectic composition of said mixture of molten salts.

7. The process as defined by claim 3, said electrolysis being carried out at a temperature ranging from 400° to 500° C.

8. The process as defined by claim 1, for the continuous preparation of lithium/calcium alloys containing at least 50 mole % of lithium, said mixture of molten salts comprising lithium chloride and calcium chloride.

9. An eIectrolytic cell for the electrolysis of molten salt to metal and a gaseous product of electrolysis comprising (i) an anode and (ii) a cathode, said cathode circumferentially surrounding said anode as to define an unrestricted interspace therebetween, said cathode being perforated at the lower end portion thereof and being adapted to establish a natural circulation of molten salt electrolytic medium within said interspace and molten metal formed by such electrolysis in admixture as a molten salt product of electrolysis, and said cathode being situated as to be below the level of the electrolytic medium when the cell is in use, said anode being situated as to be both above and below the level of the electrolytic medium when the cell is in use, said anode comprising an inert sheath member eveloping the surface area thereof entirely above and slightly below the level of the electrolytic medium when the cell is in use, (iii) molten salt inlet means, (iv) means for withdrawing molten salt product of electrolysis wherein said molten salt product of electrolysis is in contact with the gaseous product of electrolysis, and (v) means for discharging said gaseous product of electrolysis.

10. The electrolytic cell as defined by claim 9, said sheath comprising an inert refractory material.

11. The electrolytic cell as defined by claim 9, said cathode being outwardly flared at the upper end portion thereof.

12. The electrolytic cell as defined by claim 11, said means for withdrawing molten salt product of electrolysis comprising an overflow conduit.

13. The electrolytic cell as defined by claim 12, said overflow conduit being adapted to establish the level of the electrolytic medium therein when the cell is in use.

14. The electrolytic cell as defined by claim 9, comprising a plurality of anode/cathode electrode pairs.

15. A process for the continuous preparation of predetermined amount of lithium metal, comprising, (i) in an electrolytic cell, continuously electrolyzing the lithium chloride which comprises a mixture of molten salts, which mixture comprises the medium of electrolysis, (ii) continuously transferring therefrom lithium metal in admixture with the mixture of molten salts to a zone of separation, and there (iii) continuously separating product lithium metal from said mixture of molten salts.

16. The process as defined by claim 15, said medium of electrolysis naturally circulating within an interspace defined between the electrodes of the cell, said interspace being devoid of physical barrier between said electrodes.

17. The process as defined by claim 16, further comprising continuously discharging undiluted chlorine gas from said admixture of lithium metal and mixture of molten salts.

18. The process as defined by claim 15, wherein said step (iii) comprises decanting and recovering product lithium metal from said mixture of molten salts.

19. The process as defined by claim 18, further comprising recycling said separated mixture of molten salts to said electrolytic cell.

20. The process as defined by claim 19, further comprising filtering said mixture of molten salts prior to recycle thereof.

21. The process as defined by claim 18, comprising decanting in a decantation compartment of said zone of separation, said compartment having a surface area S such that $0.1<S/Q<0.3$, wherein Q is the rate of feed therein in $m^3$/hour and S is in $m^2$.

22. The process as defined by claim 15, said mixture of molten salts comprising lithium chloride and at least one other alkali or alkaline earth metal chloride.

23. The process as defined by claim 22, said mixture of molten salts being essentially eutectic in composition.

24. The process as defined by claim 22, said mixture of molten salts comprising lithium chloride and potassium chloride.

25. The process as defined by claim 24, said lithium chloride being present in an excess of up to 10 mole % with respect to the eutectic composition of said mixture of molten salts.

26. The process as defined by claim 22, said electrolysis being carried out at a temperature ranging from 400° to 500° C.

27. Electrolysis apparatus which comprises an electrolytic cell including (i) an anode and (ii) a cathode, said cathode circumferentially surrounding said anode as to define an unrestricted interspace therebetween, said cathode being perforated at the lower end portion thereof and being adapted to establish a natural circulation of electrolytic medium within said interspace, and said cathode being situated as to be below the level of the electrolytic medium when the cell is in use, said anode being situated as to be both above and below the level of the electrolytic medium when the cell is in use, (iii) molten salt inlet means, (iv) means for withdrawing molten salt product of electrolysis, and (v) means for separating said molten salt product of electrolysis into lithium metal and remaining medium of electrolysis.

28. The apparatus as defined by claim 27, said separating means comprising a zone for decanting lithium metal from said molten salt product of electrolysis.

29. The apparatus as defined by claim 28, further comprising means for recycling remaining medium of electrolysis to said electrolytic cell.

30. The apparatus as defined by claim 29, further comprising means for filtering said remaining medium of electrolysis, prior to the recycle thereof.

31. The apparatus as defined by claim 29, said decanting zone comprising a lithium metal overflow conduit.

32. The apparatus as defined by claim 31, said recycling means comprising a remaining medium of electrolysis overflow conduit.

33. The apparatus as defined by claim 32, further comprising a holding vessel downstream of said electrolysis overflow and upstream of the recycle to said electrolytic cell.

34. The apparatus as defined by claim 28, said decanting zone having a surface area S such that $0.1<S/Q<0.3$, wherein Q is the rate of feed therein in $m^3$/hour and S is in $m^2$.

35. The apparatus as defined by claim 28, said separating means further comprising a discharge well for remaining medium of electrolysis.

36. The apparatus as defined by claim 27, further comprising (vi) means for discharging gaseous product of electrolysis.

37. The apparatus as defined by claim 27, said anode comprising an inert sheath member enveloping the surface area thereof entirely above and slightly below the level of the electrolytic medium when the cell is in use.

38. The apparatus as defined by claim 37, said sheath comprising an inert refractory material.

39. The apparatus as defined by claim 37, said cathode being outwardly flared at the upper end portion thereof.

40. The apparatus as defined by claim 39, said means for withdrawing molten salt product of electrolysis comprising an overflow conduit.

41. The apparatus as defined by claim 40, said overflow conduit being adapted to establish the level of the electrolytic medium therein when the cell is in use.

* * * * *